US007210775B2

(12) United States Patent
Hoshino

(10) Patent No.: US 7,210,775 B2
(45) Date of Patent: May 1, 2007

(54) INK JET RECORDING APPARATUS

(75) Inventor: Yoshihide Hoshino, Hachioji (JP)

(73) Assignee: Konica Corporation, Tokyo (JP)

( * ) Notice: Subject to any disclaimer, the term of this patent is extended or adjusted under 35 U.S.C. 154(b) by 162 days.

(21) Appl. No.: 10/648,657

(22) Filed: Aug. 26, 2003

(65) Prior Publication Data

US 2004/0041893 A1 Mar. 4, 2004

(30) Foreign Application Priority Data

Aug. 29, 2002 (JP) ..... 2002-250637

(51) Int. Cl.
*B41J 2/01* (2006.01)

(52) U.S. Cl. ..... 347/102; 347/17

(58) Field of Classification Search ..... 347/101, 347/102, 100, 17, 13, 105, 5, 95, 96, 18; 34/1; 219/216; 101/488; 399/320
See application file for complete search history.

(56) References Cited

U.S. PATENT DOCUMENTS 5,287,123 A * 2/1994 Medin et al. ..... 347/102
6,114,406 A 9/2000 Caiger et al.
6,460,990 B2 * 10/2002 Yraceburu et al. ..... 347/102
6,523,948 B2 * 2/2003 Matsumoto et al. ..... 347/102
6,619,777 B2 * 9/2003 Chang ..... 347/10
6,746,115 B2 * 6/2004 Tomotake et al. ..... 347/100
6,764,174 B2 * 7/2004 Sekiya ..... 347/102
2003/0128264 A1 * 7/2003 Ishikawa et al. ..... 347/102
2003/0231234 A1 * 12/2003 Ushirogouchi et al. ..... 347/102

FOREIGN PATENT DOCUMENTS

EP 0307251 A2 * 3/1989
JP 60-119554 6/1985
JP 06-200204 7/1994

* cited by examiner

*Primary Examiner*—Manish S. Shah
(74) *Attorney, Agent, or Firm*—Cohen Pontani Lieberman & Pavane LLP

(57) ABSTRACT

An ink jet recording apparatus for forming an image on a recording medium having: a carrying section for carrying the recording medium; a line head for jetting ink to the recording medium, the head line being provided in a direction approximately perpendicular to a carrying direction of the recording medium which is carried by the carrying section; an active energy ray radiation section for radiating an active energy ray to the ink jetted on the recording medium to cure the ink; and a temperature controlling mechanism for controlling the temperature of the recording medium which is carried by the carrying section within a preset target temperature range.

20 Claims, 3 Drawing Sheets

| HUMIDITY | UPPER THRESHOLD TEMPERATURE | LOWER THRESHOLD TEMPERATURE |
|---|---|---|
| a1 | b1 | c1 |
| a2 | b2 | c2 |
| a3 | b3 | c3 |
| a4 | b4 | c4 |
| a5 | b5 | c5 |

*FIG.4*

| MEDIUM RECEIVED HEAT QUANTITY AT UPSTREAM POSITION | RETAINING HEAT QUANTITY AT IMAGE FORMING POSITION | HEAT QUANTITY LOSS DURING CARRYING | INK CURING |
|---|---|---|---|
| 100% | 100% | 0% | ○ |
| 100% | 99% | 1% | ○ |
| 100% | 97% | 3% | ○ |
| 100% | 93% | 7% | ○ |
| 100% | 90% | 10% | ○ |
| 100% | 87% | 13% | △ |
| 100% | 84% | 16% | × |

INK JET RECORDING APPARATUS

BACKGROUND OF THE INVENTION

1. Field of the Invention

The present invention relates to an ink jet recording apparatus which jets ink in droplets form onto a recording medium to form an image thereon.

2. Description of the Related Art

Recently, in an ink jet image forming method, an image can be formed easily and at low cost in comparison with a gravure printing method, so that the ink jet image forming method has been applied in various printing fields such as special printing and the like, that is, a photograph, various printings, marking, color filter and so forth.

Particularly, in the ink jet image forming method, an ink jet recording apparatus of the ink jet image forming method which jets and controls a small dot, ink which has an improved gamut of color reproduction, endurance, aptitude for jetting ink and the like, and an specific paper which has dramatically improved ink absorptivity, coloring property of coloring material, surface gloss and the like are combined for use so as to obtain image quality comparable to a silver salt photograph.

An improved image quality of the ink jet image forming method can be obtained when the ink jet recording apparatus, the ink and the specific paper are all provided. However, if the recording apparatus needs the specific paper, the type of recording medium is limited. This results in high cost for recording medium and restricted application of the ink jet recording apparatus. Thus, lots of attempts have been made to form an image by the ink jet image forming method on a recording medium other than the specific paper. To put it more concretely, that is a phase-change ink jet method using wax ink which is solid at room temperature, a solvent-based ink jet method using an ink which main component is a quick-drying organic solvent, a UV ink jet method in which ink is irradiated with ultraviolet (UV) after forming an image and the like.

Particularly, in the UV ink jet method, less odor is produced in comparison with the solvent-based ink jet method. Moreover, an image can be formed on a recording medium which is no quick-drying property and absorptivity. Thus, recently, much attention has been paid to the UV ink jet method. For example, Japanese Patent Application Publication (Examined) No. Tokukou-Hei 5-54667, Japanese Patent Application (Unexamined) No. Tokukai-Hei 6-200204 and Patent Application Kohyo Publication (National Publication of Japanese Translation Version) No. Tokuhyo 2000-504778 disclose an ultraviolet curable ink (hereinafter referred to simply as UV ink).

However, the diameter of a dot changes a lot after placing the ink according to the working environment or the type of a recording medium even if the UV ink is used. Thus, there is less possibility to form an image with a high quality and a high-definition on any type of recording medium.

In a usual UV ink, there is a problem that the UV ink shrinks while curing, so that a recording medium shrinks as the UV ink shrinks. Specially, the ink shrinks more while curing on a thin plastic film, an adhesive label or the like which is used for soft packing including food packing. Accordingly, the UV ink jet method has not been put to practical use in printing on the soft packing or label printing.

Radical polymerization ink and cationic polymerization ink have been known as the UV ink. The inventors have found that shrinkage of the ink which occurs while forming an image can be prevented by using the cationic polymerization ink, specially the cationic polymerization ink with a specific composition, even if the jetted ink is received on the above-described thin plastic film or adhesive label.

However, the curing property of the cationic polymerization ink is easily affected by water (humidity). For example, when the cationic polymerization ink is received on the recording medium to form an image, there is a problem that the cationic polymerization ink is not cured enough due to an effect of ambient humidity even if UV radiation is irradiated on the cationic polymerization ink.

A UV ink jet recording apparatus jets the UV ink from a head toward the recording medium. When the UV ink which is jetted from the UV ink jet recording apparatus is received on the recording medium, the UV ink with droplets form spreads on a surface of the recording medium to form a UV ink dot on the recording medium. It is preferable that each diameter of a plurality of dots which are formed on the recording medium does not differ a lot for forming a high-definition image on the recording medium. However, if the cationic polymerization ink is not cured in a short period of time after irradiation of UV radiation due to an effect of ambient humidity as described above, each diameter of the dots greatly differs. Accordingly, in light of forming a high-definition image, the effect of humidity cannot be neglected.

SUMMARY OF THE INVENTION

An object of the present invention is to provide an ink jet recording apparatus which can form a high-definition image.

In the first aspect of the invention, an ink jet recording apparatus for forming an image on a recording medium comprises:

a carrying section for carrying the recording medium;

a line head for jetting ink to the recording medium, the head line being provided in a direction approximately perpendicular to a carrying direction of the recording medium which is carried by the carrying section;

an active energy ray radiation section for radiating an active energy ray to the ink jetted on the recording medium to cure the ink; and a temperature controlling mechanism for controlling the temperature of the recording medium which is carried by the carrying section within a preset target temperature range.

According to the ink jet recording apparatus of the present invention, because the temperature of the recording medium is controlled by the temperature controlling mechanism so as to be within the preset target temperature range, the temperature of the recording medium can be substantially constant. Thus, the jetted ink received on the recording medium can obtain a temperature in which the ink is cured enough, and the recording medium can obtain a temperature which is not adversely affected by the radiation of the active energy ray, so that the jetted ink received on the recording medium can be cured in a short time by the radiation of the active energy ray. Accordingly, a diameter of jetted ink dot received on the recording medium can be stabilized.

If a type of the ink and the recording medium are not changed, the temperature of any ink received on the recording medium can be substantially constant by making the temperature of the recording medium be substantially constant. Accordingly, the curing speed and viscosity of the jetted ink which is received on the recording medium can be substantially constant, so that the diameter of the jetted ink dot received on the recording medium can be stabilized more reliably.

The line head is provided in a direction approximately perpendicular to the carrying direction of the recording medium which is carried, so that an image can be formed on the recording medium without making the line head scan in a direction approximately perpendicular to the carrying direction of the recording medium. In a scanning type ink jet recording apparatus, the recording medium should be stopped while an ink jet head is scanning (that is, the recording medium should be carried intermittently). However, in the present invention, it is unnecessary to make the line head scan so that the recording medium can be carried continuously without being stopped. Since the recording medium is carried continuously, the recording medium is heated or cooled without partially focused by the temperature controlling mechanism, so that the temperature of the recording medium can be approximately constant within the preset target temperature. Accordingly, the diameter of the jetted ink dot received on the recording medium can be stabilized more reliably.

As described above, because the diameter of the jetted ink dot can be stabilized, color mixing does not occur on the recording medium and a high-definition image can be formed.

Preferably, the active energy ray includes a wavelength component which is out of the visible band wavelength, that is, a wavelength component excluding the wavelength band of approximately 380–700 nm.

Preferably, in the ink jet recording apparatus of the present invention, the ink has cationic polymerization characteristics.

Accordingly, since the ink has cationic polymerization characteristics, the ink does not shrink while curing. Thus, the shrinkage can be prevented when an image is formed even on a soft recording medium such as a thin plastic film or an adhesive label. The cationic polymerization ink may not be cured enough depending on ambient humidity while curing. However, when the cationic polymerization ink is cured by radiation of the active energy ray, a polymerization reaction of a cationic polymerization substance which is contained in the cationic polymerization ink is accelerated by heat of the recording medium by controlling the temperature of the recording medium on which the cationic polymerization ink is received. Thus, the cationic polymerization ink can be cured enough. Accordingly, a high quality image can be formed on various types of recording medium.

Preferably, the temperature controlling mechanism controls a temperature of the recording medium which is carried by the carrying section within the preset target temperature range at least at one of an image forming position facing to the line head where an image is formed on the recording medium by receiving the jetted ink on the recording medium carried by the carrying section, and a position which is upstream position of the image forming position in a carrying direction.

Accordingly, since the temperature of the recording medium is controlled within the preset target temperature range at least at one of the image forming position which is facing to the line head and the position which is upstream position of the image forming position in the carrying direction, the jetted ink received on the recording medium can obtain a temperature in which the ink is cured enough at the time the jetted ink is received on the recording medium.

When the temperature to cure the ink enough is obtained after the jetted ink is received on the recording medium, there is a time lag from the time when the jetted ink is received on the recording medium to the time when the temperature of the ink changes, so that the ink may blot. However, in the present invention, since the temperature to cure the ink enough can be obtained at the time when the jetted ink is received on the recording medium, the ink does not blot. Accordingly, ink mixing of different colors does not occur.

A heat quantity loss may be not more than 15% of a heat quantity which is applied to the recording medium, when the recording medium is carried to the image forming position after received certain heat quantity which is determined by adjusting temperature of the recording medium, in a case of the temperature controlling mechanism being provided only at the upstream position in the carrying direction.

Accordingly, as shown in FIG. 4, the jetted ink is received on the recording medium which has more than or equal to 85% of the heat quantity applied to the recording medium, so that the temperature to cure the ink enough can be obtained.

The heat quantity is synonymous with the general definition (amount of energy) and indicates an amount of energy which is applied to the recording medium by the temperature adjusting section. To put it more concretely, if the temperature of the recording medium "T" is detected, and heat capacity is calculated by multiplying a specific heat "k" of the recording medium by a weight of the recording medium "M" at a temperature controlling region, the amount of energy can be calculated by multiplying the heat capacity "kM" by the temperature "T" ("kM×T").

Thus, preferably, the upstream position of the image forming position in the carrying direction at which the temperature adjusting section is disposed is from a start point of a printing region to a position which is about double widths of the printing region away from the start point.

Preferably, the temperature controlling mechanism comprises:

a temperature detecting section for detecting temperature of the recording medium;

a temperature adjusting section for carrying out at least one of heating and cooling to the recording medium which is carried by the carrying section; and a control section for controlling the temperature adjusting section by comparing a temperature detected by the temperature detecting section with a preset temperature.

Accordingly, the temperature controlling mechanism controls the temperature adjusting section based on the detected result of the temperature of the temperature adjusting section, so that the output of the temperature adjusting section can be changed corresponding to the temperature of the recording medium. That is, when the temperature of the recording medium is around the preset target temperature range, the heating or the cooling by the temperature adjusting section can be lowered, and when the temperature of the recording medium is not around the preset target temperature range, the heating or the cooling by the temperature adjusting section can be raised. Thus, the temperature of the recording medium can be controlled efficiently.

Preferably, in the ink jet recording apparatus of the present invention, the apparatus further comprises a humidity detecting section for detecting humidity around the recording medium, and the preset temperature is changed according to the detected humidity.

Preferably, the preset temperature rises corresponding to an increase of the detected humidity.

The preset temperature may be changed according to the type of the recording medium.

The temperature adjusting section may be in contact with a back surface of a platen with which the recording medium is in contact, the platen keeping the recording medium flat on the printing region.

In the ink jet recording apparatus of the present invention, the temperature adjusting section may comprise a heat roller which is rotatably supported around a shaft and emits heat, and the periphery of the heat roller may be in contact with the recording medium along at least 90 degrees of center angle.

Accordingly, the recording medium contacts with the heat roller which emits heat in a wide range of area, so that the heat of the heat roller is conducted to the recording medium efficiently so as to heat the recording medium efficiently. Thus, the temperature of the recording medium can be controlled efficiently.

In the ink jet recording apparatus of the present invention, the temperature adjusting section may comprise a heat plate in plate shape which emits heat, and the heat plate may be in contact with the recording medium by a component of a force which is generated when carrying the recording medium.

Accordingly, the component of the force for carrying the recording medium is applied to contact the recording medium tightly with the heat plate which emits heat, so that the heat of the heat plate is conducted to the recording medium efficiently so as to heat the recording medium efficiently. Thus, the temperature of the recording medium can be controlled efficiently.

In the ink jet recording apparatus of the present invention, the temperature adjusting section may comprise a peltier element which is used with a heat transfer member for transferring heat to the recording medium, and the heat transfer member may be in contact with the recording medium by a component of a force which is generated when carrying the recording medium.

Accordingly, the recording medium tightly contacts with a heat radiation portion of the peltier element, so that the heat of the heat radiation portion is conducted to the recording medium efficiently so as to heat the recording medium efficiently. In addition, when the recording medium tightly contacts with a heat absorption portion of the peltier element, the heat of the recording medium is conducted to the absorption portion efficiently so as to cool the recording medium efficiently. Thus, the temperature of the recording medium can be controlled efficiently.

In the ink jet recording apparatus of the present invention, the temperature adjusting section may comprise an air blowing apparatus which directs heated air to the recording medium carried by the carrying section.

Accordingly, since the heated air is directed to the recording medium, the recording medium is heated efficiently by heat transmission. Thus, the temperature of the recording medium can be controlled efficiently.

The temperature adjusting section may be arranged in the opposite side of the line head across the recording medium which is carried by the carrying section.

According to the structure, since the temperature adjusting section is provided on the opposite side of the line head across the recording medium, it is unnecessary to provide the temperature adjusting section between the line head and the recording medium. Thus, the line head can be disposed more closely to the recording medium. Accordingly, disperse of the ink jetted from the line head by surrounding convection or the like can be prevented.

The active energy ray may be ultraviolet radiation.

Preferably, the amount of a droplet of the ink which is jetted from the line head to the recording medium is 2–15 pl.

Preferably, the active energy ray is radiated in 0.001–2.0 seconds after the jetted ink is received on the recording medium.

Radiation of the active energy ray may be divided into a plurality of steps.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 4 is a table showing a relation between a heat cluantity loss from a recording medium and curing property of ink in the present invention.

DETAILED DESCRIPTION OF THE PREFERRED EMBODIMENTS

Hereinafter, the preferred embodiments of the present invention will be described in detail by reference to the attached drawings.

Figure 1:
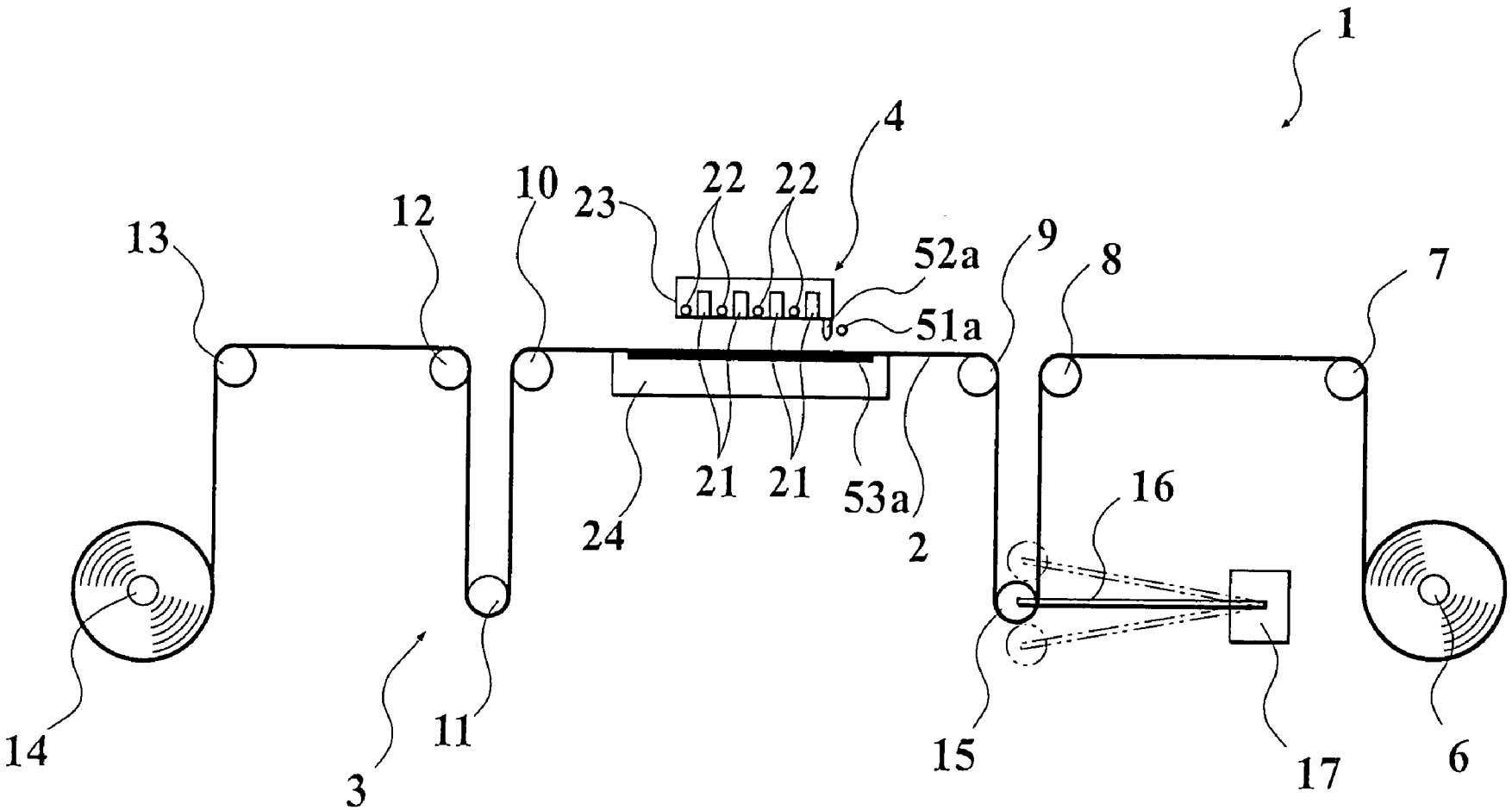
FIG. 1 is a side view showing an ink jet recording apparatus according to the present invention.

FIG. 1 is a side view showing an ink jet recording apparatus 1 according to the present invention. The ink jet recording apparatus 1 is an apparatus which jets the UV ink in droplets form toward a recording medium 2 which is continuously carried without being stopped to form an image on the recording medium 2. The ink jet recording apparatus 1 comprises a carrying member 3 for carrying the recording medium 2 having a strip film shape and an image forming portion 4 for forming an image onto the recording medium 2 which is carried by the carrying member 3.

The carrying member 3 comprises a feed roller 6, driven rollers 7–13 and a driving roller 14 which are disposed in a parallel relation each other, and a tension adjusting roller 15 which is parallel to the rollers 6–14.

The feed roller 6 is rotatably supported around the shaft, and the recording medium 2 is pre-rolled on the feed roller 6. The driven rollers 7–13 are also rotatably supported around the shaft. The driving roller 14 is rotatable around the shaft and is driven by a driving source such as a motor or the like which is not shown.

The driven rollers 7, 8, 9, 10, 12, 13 are disposed on the same horizontal plane, and arranged in the order of the driven rollers 7, 8, 9, 10, 12, 13 from upstream side in the carrying direction of the recording medium 2. The feed roller 6, the driven roller 11 and the driving roller 14 are disposed on the same horizontal plane under the driven roller 7, and arranged in the order of the feed roller 6, the driven roller 11 and the driving roller 14 from the upstream side in the carrying direction of the recording medium 2.

The tension adjusting roller 15 is rotatable around the shaft, and is provided on one end of an arm 16. The arm 16 extends in a direction perpendicular to the shafts of the rollers 6–15. A driving section 17 such as an air pressure system or an oil pressure system is connected to the other end of the arm 16. A driving force is applied to the arm 16 by the driving section 17 to rotate the arm 16 in vertical direction around the other end as a center, and the tension adjusting roller 15 is moved in vertical direction. The horizontal plane on which the feed roller 6, the driven roller 11 and the driving roller 14 are is in the range of the vertical movement of the tension adjusting roller 15. When the tension adjusting roller 15 is on the same plane with the feed roller 6, the driven roller 11 and the driving roller 14, the tension adjusting roller 15 is disposed between the feed roller 6 and the driven roller 11.

The recording medium 2 which is withdrawn from the feed roller 6 is led to the driving roller 14 through the roller 7, 8, 15, 9, 10, 11, 12, 13 in this order to form a carrying route for carrying the recording medium 2. The driving roller 14 is rotated by a driving source such as a motor to withdraw the recording medium 2 from the feed roller 6. The recording medium 2 which is withdrawn from the feed roller 6 is carried in the order of the roller 7→the roller 8→the roller 15→the roller 9→the roller 10→the roller 11→the roller 12→the roller 13→the driving roller 14.

When the arm 16 is rotated upward by the driving section 17, the tension adjusting roller 15 moves close to the driven roller 8 and the driven roller 9. Thus, the carrying route for carrying the recording medium 2 is shortened, whereby the tension to the recording medium 2 is eased to reduce the tension applied to the recording medium 2. When the arm 16 is rotated downward by the driving section 17, the tension adjusting roller 15 moves away from the driven roller 8 and the driven roller 9. Thus, the carrying route for carrying the recording medium 2 becomes long, whereby the recording medium 2 is pulled and the tension applied to the recording medium 2 increases.

The image forming portion 4 is disposed upward of the recording medium 2 which is tensioned between the driven roller 9 and the driven roller 10 so as to face to the recording medium 2. The image forming portion 4 comprises a plurality of line heads 21, 21, . . . , a plurality of UV light sources 22, 22, . . . and a supporter 23 for supporting the line heads 21, 21, . . . and the light sources 22, 22, . . . .

The line head 21 is disposed to be adapted to extend in a direction perpendicular to the direction in which the recording medium 2 is carried from the driven roller 9 to the driven roller 10, that is, the width direction of the recording medium 2. The lower surface of the line head 21 is facing the recording medium 2 which is tensioned between the driven roller 9 and the driven roller 10. A plurality of openings for jetting ink is arranged on the lower surface of the line head 21 and forms a line in width direction of the recording medium 2. In the line head 21, an ink jetting section such as a piezoelectric element is provided corresponding to each opening for jetting ink. The UV ink is jetted from each opening for jetting ink in droplets form by each ink jetting section. The line head 21 is attached on the supporter 23 to be arranged in a plurality of lines in the carrying direction of the recording medium 2. Any one of the colors of the UV ink (yellow, magenta, cyan and black as a basic color, and there are other colors such as white, light yellow, light magenta, light cyan, light black and the like) is jetted from one line head 21. Basically, droplets of the UV ink with different color is jetted from each line head 21, however, the UV ink with the same color may be jetted from more than one line head 21.

The UV light source 22 is disposed in downstream side of each line heads 21 in a direction in which the recording medium 2 is carried from the driven roller 9 to the driven roller 10, and attached to the supporter 23. That is, the UV light source 22 and the line head 21 are alternately disposed in the carrying direction of the recording medium 2. The UV light source 22 is disposed to be adapted to extend in the width direction of the recording medium 2 same as the line head 21. The UV light source 22 irradiates UV radiation toward the recording medium 2 which is carried from the driven roller 9 to the driven roller 10.

A platen 24 is disposed under the image forming portion 4 to be adapted to face to the image forming portion 4. The recording medium 2 is carried through the space between the platen 24 and the image forming portion 4. The platen 24 keeps the recording medium 2 in almost flat shape. The platen 24 is provided with a heat plate 53*a* on the top surface of the platen 24, and the heat plate 53*a* has a flat shape and is disposed in the width direction of the recording medium 2. The surface of the heat plate 53*a* forms the top surface of the platen 24. The recording medium 2 carried from the driven roller 9 to the driven roller 10 contacts with the surface of the heat plate 53*a*, and is heated by heat generated by the heat plate 53*a*. The top surface of the platen 24 (heat plate 53*a*) which is along the carrying route for the recording medium 2 is the image forming position where droplets of the UV ink jetted from the line head 21,21, . . . are received on the recording medium 2 to form an image.

Control of the ink jet recording apparatus 1 according to the embodiment will be explained referring to FIG. 2.

Figures 2, 3:
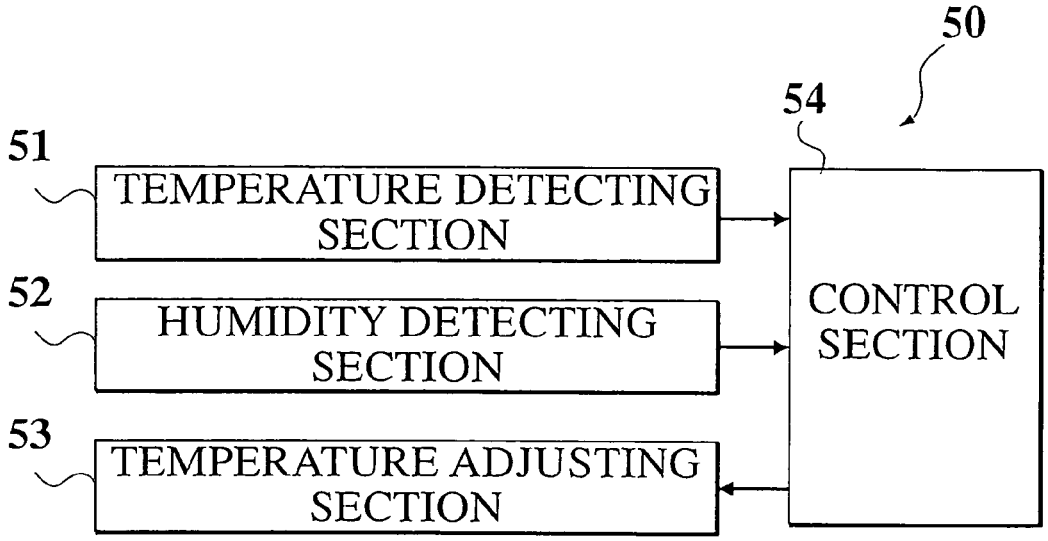
FIG. 2 is a functional block diagram showing a temperature controlling mechanism in the ink jet recording apparatus shown in FIG. 1.
FIG. 3 is a figure showing one example of a data table which is used for a control operation by the temperature controlling mechanism.

The ink jet recording apparatus 1 comprises a medium temperature controlling mechanism 50 as shown in FIG. 2.

The medium temperature controlling mechanism 50 is for controlling the UV ink received on the recording medium 2 to a desired temperature by controlling a temperature of the recording medium 2 on which an image is formed on the platen 24 by the line head 21 within the preset target temperature range. Since the temperature of the UV ink received on the recording medium 2 is controlled to the desired temperature, the UV ink received on the recording medium 2 is cured without being affected by humidity. The preset target temperature range is a temperature range in which photo-curable ink is cured enough even if the humidity in atmosphere is high enough to obstruct cuing of the photo-curable ink such as the UV ink or the like.

The medium temperature controlling mechanism 50 comprises a temperature detecting section 51, a humidity detecting section 52, a temperature adjusting section 53 and a control section 54. The temperature detecting section 51, the humidity detecting section 52 and the temperature adjusting section 53 are connected to the control section 54.

The temperature adjusting section 53 is provided at the image forming position or a position which is upstream of the image forming position in the direction of the carrying route, where heat is applied to the recording medium 2 to heat the recording medium 2. The temperature adjusting section 53 also comprises a cooling function. When the temperature of the recording medium 2 rises too high by heating or when the temperature around the recording medium 2 rises too high at the image forming position, the recording medium 2 may be cooled by radiating the heat from the recording medium 2 by the temperature adjusting section 53.

To put it more concretely, the temperature adjusting section 53 is the heat plate 53*a* (shown in FIG. 1) which generates heat to apply heat to the recording medium 2 and heat the recording medium 2 at the image forming position. Other example of the temperature adjusting section 53 may be a heat roller. In this case, a heat generation function may be provided to the driven roller 9 which is disposed at the upstream side of the image forming position in the direction of the carrying route to function as the heat roller. Heat may be applied to the recording medium 2 to be heated. An air fan which directs a heated gas to the recording medium 2 as a heated air may be provided near the image forming position as the temperature adjusting section 53. In this case, the recording medium 2 may be heated at the image forming position or a position which is the upstream side of the image forming position in the direction of the carrying route. A heating element such as a heater may be provided near the image forming position as the temperature adjusting section 53. The heat generated by the heating element may be conducted, transmitted or radiated to the recording medium 2 to heat the recording medium 2 at the image forming position or a position which is the upstream side of the image forming position in the direction of the carrying route. Further, a peltier element which exchanges heat between the heat radiation portion and the absorption portion by applying current may be disposed near the image forming position as the temperature adjusting section 53. In this case, the recording medium 2 may be heated at the image forming position or a position which is the upstream side of the image forming position in the direction of the carrying route by contacting the heat radiation portion with the recording medium 2.

When the above-described air fan, peltier element or heating element is disposed near the image forming position, they may be disposed, for example, at a position corresponding to the position of the heat plate 53*a* shown in FIG. 1 or at a position downward of the heat plate 53*a*. When the air fan is disposed downward the heat plate 53*a*, an air hole is formed in the platen 24 to direct air generated by the air fan to the recording medium 2 through the air hole.

When the temperature adjusting section 53 comprises a cooling function, the temperature adjusting section 53 can be of cooling the recording medium 2 by heat of vaporization such as a heat pump or the like, or the heat absorption portion of the peltier element or the like. Further, if the temperature adjusting section 53 is for cooling the recording medium 2 to around the room temperature, a cooling fan which directs air of around the room temperature to the recording medium 2 can be used as the temperature adjusting section 53. The peltier element may be provided so as to make the heat absorption portion contact with the recording medium 2 at the image forming position.

If the above-described temperature adjusting section 53 directly contacts with the recording medium 2 like the heat plate 53*a* or the heat roller 9 having a heat radiation function, heat is conducted efficiently between the temperature adjusting section 53 and the recording medium 2 so that the temperature of the recording medium 2 can be adjusted efficiently.

A few examples of the temperature adjusting section 53 are given as described above, however it is not limited to the above-described examples, if the temperature adjusting section 53 is of heating or cooling the recording medium 2 by applying heat to the recording medium 2 or absorbing heat from the recording medium 2 at the image forming position or a position which is the upstream side of the image forming position. The temperature adjusting section 53 may function only either for cooling or heating the recording medium 2, or may function for both of cooling and heating the recording medium 2.

A heat quantity loss may be not more than 15% of a heat quantity which is applied to the recording medium, when the recording medium is carried to the image forming position after received certain heat quantity which is determined by adjusting temperature of the recording medium, in a case of the temperature controlling mechanism being provided only at the upstream position in the carrying direction.

Accordingly, as shown in FIG. 4, the jetted ink is received on the recording medium which has more than or equal to 85% of the heat quantity applied to the recording medium, so that the temperature to cure the ink enough can be obtained.

The heat quantity is synonymous with the general definition (amount of energy) and indicates an amount of energy which is applied to the recording medium by the temperature adjusting section. To put it more concretely, if the temperature of the recording medium "T" is detected, and heat capacity is calculated by multiplying a specific heat "k" of the recording medium by a weight of the recording medium "M" at a temperature controlling region, the amount of energy can be calculated by multiplying the heat capacity "kM" by the temperature "T" ("kM×T").

Thus, preferably, the upstream position of the image forming position in the carrying direction at which the temperature adjusting section is disposed is from a start point of a printing region to a position which is about double widths of the printing region away from the start point.

The temperature detecting section 51 is disposed near the image forming position to detect the temperature of the recording medium 2 which is adjusted by applying heat to the recording medium 2 or absorbing heat from the recording medium 2 by the temperature adjusting section 53. The temperature detecting section 51 outputs a temperature which is detected (hereinafter referred to "detected temperature") to the control section 54 as an electric signal. For example, as shown in FIG. 1, the temperature detecting section 51 is a non-contact type temperature sensor 51*a* which is disposed upstream of the image forming position so as to be facing to a surface of the recording medium 2 on which an image is formed. The non-contact type temperature sensor 51*a* detects temperature of the heated or cooled recording medium 2 without contacting with the recording medium 2.

The humidity detecting section 52 is disposed near the image forming position to detect humidity between the line head 21 and the recording medium 2. For example, as shown in FIG. 1, the humidity detecting section 52 is a humidity sensor 52*a* which is attached on the supporter 23 and extends downward therefrom so as not to contact with the recording medium 2. The humidity sensor 52*a* detects humidity between the line head 21 and the recording medium 2. The humidity detecting section 52 outputs humidity which is detected (hereinafter referred to "detected humidity") to the control section 54 as an electric signal.

The control section 54 basically controls the temperature adjusting section 53 based on the electric signal indicating the detected temperature which is detected by the temperature detecting section 51 and the electric signal indicating the detected humidity detected by the humidity detecting section 52. The control section 54 comprises a processor having a general-purpose CPU (central processing unit), a memory and the like, or a dedicated logic circuit. The control section 54 can recognize the detected temperature and humidity and output a control signal to the temperature adjusting section 53 by the CPU or the logic circuit. Since the control section 54 outputs the control signal based on the detected temperature and humidity to the temperature adjusting section 53, the temperature adjusting section 53 can carry out heating operation, cooling operation, stop of the heating operation, stop of the cooling operation, increase or decrease of heating energy, and increase or decrease of cooling energy according to the control signal.

Next, the UV ink used for the ink jet recording apparatus 1 will be explained. The UV ink is a cationic polymerization type. More specifically, the UV ink includes at least a cation polymeric compound which is curable through polymerization reaction when irradiated with UV radiation, a photo-cation initiator (photo acid generator) for initiating the polymerization reaction for the cation polymeric compound when irradiated with UV radiation, and colorants for coloring as ink. The UV ink of the cationic polymerization type is easily affected by humidity and temperature. Thus, most of the UV inks have a curing property as follows. The UV ink becomes difficult to be cured as the humidity rises. Also, the UV ink becomes easily curable as the temperature rises. The ink further may include at least one of well-known various additives used for a cationic polymerization type of optical curable resin.

The UV ink is used in this example, however, ink may not be limited to the ink which is irradiated with UV radiation for initiating curing. The photo-cation initiator which initiates the polymerization by irradiating with light other than UV radiation (for example, infrared rays or visible rays) may be used. Recently, the development of electron beam curable ink has been advancing, so that electronic beam may be adapted as the active energy ray. That is, the active energy ray in the present invention includes electron beam or the like as well as electromagnetic wave including light in a broad sense such as visible rays, UV radiation and infrared rays, electromagnetic wave including X-ray or the like. In the embodiment, an example will be explained using UV radiation as the active energy ray.

The cation polymeric compound can apply any of well-known various cation polymeric monomers. For example, epoxy compound, vinyl ether compound, octane compound or the like is preferable as disclosed in Japanese Patent Application Publication (Unexamined) Nos. Tokukai-hei 6-9714, Tokukai 2001-31892, Tokukai 2001-40068, Tokukai 2001-55507, Tokukai 2001-310938, Tokukai 2001-310937 and Tokukai 2001-220526.

As aromatic epoxide, preferable one is di- or poly-glycidyl ether, which is synthesized by the reaction of polyhydric phenol having at least one aromatic core or alkylene oxide-added polyhydric phenol and epichlorohydrin, and for example, di- or poly-glycidyl ether of bisphenol A or of alkylene oxide-added bisphenol A, di- or poly-glycidyle ether of hydrogenated bisphenol A or of alkylene oxide-added hydrogenated bisphenol A, and novolak type epoky resion, are listed. Herein, as alkylene oxide, ethylene oxide and propylene oxide are listed.

As alicyclic epoxide, a cyclohexen oxide or cyclopentene oxide, which is obtained by epoxidation of the compound having cycloalkane ring such as at least one cyclohexen or cyclopentene ring by the appropriate oxidant such as hydrogen peroxide or peracid, is preferable.

As a preferable aliphatic epoxide, there is di- or poly-glycidyl ether of aliphatic polyvalent alcohol or of alkylene oxide-added aliphatic polyvalent alcohol, and as its representative example, di-glycidyl ether of alkylene glycol such as di-glycidyl ether of ethylene glycol, di-glycidyl ether of propylene glycol and glycidyl ether of 1,6-hexane diol, poly-glycidyl ether of polyvalent alcohol such as di-or tri-glycidyl ether of glyceline or of alkylene oxide added glyceline, and di-glycidyl ether of polyalkylene glycol such as di-glycidyl ether of polyethylene glycol or of alkylene oxide-added polyethylene glycol, and di-glycidyl ether of polypropylene glycol or of alkylene oxide-added polypropylene glycol, are listed. Herein, as alkylene oxide, ethylene oxide and propylene oxide are listed.

In these epoxides, when the quick hardening ability is considered, aromatic epoxide and alicyclic epoxide are preferable, and particularly, alicyclic epoxide is preferable. In the present embodiment, on kind of the above epoxides may be solely used, and more than 2 kinds of them may also be used by appropriately being combined.

As a vinyl ether compound, for example, di or tri-vinyl ether compound, such as ethylene glycol di-vinyl ether, di-ethylene glycol di-vinyl ether, tri-ethylene glycol di-vinyl ether, propylene glycol di-vinyl ether, di-propylene glycol di-vinyl ether, butane diol di-vinyl ether, hexane diol di-vinyl ether, cyclohexane di-methanol di-vinyl ether, tri-methylol propane tri-vinyl ether, or mono vinyl ether compound, such as ethyl vinyl ether, n-butyl vinyl ether, iso-butyl vinyl ether, octadecyl vinyl ether, cyclohexyl vinyl ether, hydroxy butyl vinyl ether, 2-ethyl-hexyl vinyl ether, cycro-hexane di-methanol mono-vinyl ether, n-propyl vinyl ether, iso-propyl vinyl ether, iso-propenyl ether-o-propylene carbonate, dodecyl vinyl ether, or di-ethylene glycol mono vinyl ether vinyl ether, is listed.

In these vinyl ether compounds, when the hardenability, adhesion or surface hardness is considered, di or tri-vinyl ether compound is preferable, and particularly di-vinyl ether compound is preferable. In the present invention, one kind of the above vinyl ether compounds may also be used, and more than two kinds of them may also be used by being appropriately combined.

The octane compound preferably used in the present embodiment is a compound having the octane ring, and all publicly known octane compounds as described in Japanese Patent Application Publication (Unexamined) Nos. Tokukai 2001-220526 and Tokukai 2001-310937, can be used. This invention does not preclude the use of plural octane compounds in the same time.

In the compound having the octane ring used in the present invention, the compound having 1–4 octane rings is preferable. When the compound having the octane rings of 1 to 4 is used, because the viscosity of the composition can be kept appropriately, the handling becomes not difficult, or the glass transition temperature of the composition can be also maintained properly to use, the coking property of the hardened material becomes sufficient.

The production method of the compound having the octane ring is not particularly limited, and it may be conducted according to the conventionally known method, and for example, there is a synthetic method of an octane ring from diol disclosed by Pattison (D. B. Pattision, J. Am. Chem. Soc., 3455, 79 (1957)). Further, other than them, compounds having 1–4 octane rings, which have high molecular weight of molecular weight of about 1000–5000, are also listed.

In the present embodiment, in order to prevent the recording medium 2 from shrinking as ink shrinks, preferably, ink includes at least one kind of compound selected among octane compound, epoxy compound and vinyl ether compound as photo polymeric compound.

As the photo-cation polymeric initiator, for example, a chemical amplification type photo resist or compound used for the light cationic polymerization is used (Organic electronics material seminar "Organic material for imaging" from Bunshin publishing house (1993), refer to page 187–192). Examples preferable for the present invention will be listed below.

Firstly, aromatic onium compound $B(C_6F_5)_4$—, $PF_6$—, $AsF_6$—, $SbF_6$—, $CF_3SO_3$— salt, such as diazonium, ammonium, iodonium, sulfonium, phosphonium, can be listed.

The compound including borate compound as counter anion is preferable because of high acid generative ability.

Secondly, sulfone compounds, which generate sulfonic acid, can be listed.

Thirdly, halogenide which generates hydrogen halide can also be used.

Fourthly, ferrite allen complex can be listed.

As the ink used in the present embodiment, it is preferable that an acid breeding agent, which newly generates the acid by the acid generated by the irradiation of light which is already publicly known, commencing with Japanese Patent Application Publication (Unexamined) Nos. Tokukai-hei 8-248561 and Tokukai-hei 9-034106, is included. By using the acid breeding agent, the more increase of jetting stability is made possible.

As the ink used in the present embodiment, it is preferable that a photo acid generator which is at least one selected from aromatic onium compound of diazonium, iodonium or sulfonium having aryl borate compound as counter ion, and iron allene complex is included.

As the colorants, the colorants, which can be solved or dispersed in main component of the polymeric compound, can be used, however, from the point of weather fastness, the pigment is preferable. As the pigment, the following can be used in the present embodiment, however, it is not limited to this.

C. I Pigment Yellow-1, 3, 12, 13, 14, 17, 81, 83, 87, 95, 109, 42,

C. I Pigment Orange-16, 36, 38,

C. I Pigment Red-5, 22, 38, 48: 1, 48: 2, 48: 4, 49: 1, 53: 1, 57: 1, 63: 1, 144, 146, 185, 101, C. I Pigment Violet-19, 23, C. I Pigment Blue-15: 1, 15: 3, 15: 4, 18, 60, 27, 29, C. I Pigment Green-7, 36, C. I Pigment White-6, 18, 21, C. I Pigment Black-7, Further, in the present embodiment, in order to increase the screening property of the color in the transparent recording medium such as the plastic film, it is preferable that the white ink is used. Particularly, in the soft packing print, and label print, it is preferable that the white ink is used, but because the jetting amount from the line head 21 is large, the use amount of the white ink is limited in view of the jetting stability of the ink from the line head 21, and curl and wrinkle of the recording medium 2.

For the dispersion of the pigment, for example, a ball mill, a sand mill, an attritor, a roll mill, an agitator, a Henschel mixer, a colloid mill, an ultrasonic homogenizer, a Pearl mill, a wet jet mill, a paint shaker or the like may be used. Further, when the pigment is dispersed, the dispersing agent can also be added. It is preferable that, as the dispersing agent, high polymeric dispersing agent is used. As the high polymeric dispersing agent, Solsperse series of Avecia co., is listed.

Further, as the dispersion auxiliary agent, the synergist corresponding to each kind of pigment can also be used. It is preferable that 1–50 parts by weight of these dispersing agent and dispersion auxiliary agent are added to 100 parts by weight of the pigment. The dispersion medium is solvent or polymeric compound, and it is preferable that the irradiated radiation hardening type ink used in the present invention is no-solvent, because it is reacted and hardened just after the arrival of the ink. When the solvent remains in the hardened image, the problem of deterioration of solvent resistance and VOC (Volatile Organic Compound) of the remained solvent is generated. Accordingly, it is preferable in the dispersion aptitude that the dispersion medium is not solvent, but polymeric compounds, and the monomer in which the viscosity is lowest in them, is selected.

When the dispersion of the pigment is conducted, it is preferable to configure the pigment, dispersing agent, selection of diluent for the dispersion, dispersion condition and filtering condition so that average particle size of the pigment become 0.08–0.5 μm, more preferably 0.3–10 μm, still more preferably, 0.3–3 μm. By this particle size control, the nozzle plugging of the ink jet head is suppressed, and the preservation stability of the ink, ink transparency and hardening sensitivity can be maintained.

It is preferable that the density of the colorant is 1 weight % to 10 weight % of the ink used in the present embodiment.

Various additive agents other than the above-described components can be used in the ink used in the present embodiment. For example, in order to increase the keeping quality of the ink components, the polymerization inhibitor of 200–20000 ppm can be added. Because it is preferable that the UV curable ink is heated and made to low viscosity, and jetted, it is preferable for preventing the head from plugging by the thermal polymerization that the polymerization inhibitor is added. Other than that, corresponding to the necessity, the surfactant, leveling additive agent, mat agent, polyester resin for adjusting the film property, polyurethane resin, vinyl resin, acrylic resin, rubber resin, or wax can be added.

In order to improve the adhesion to the recording medium 2, it is also effective that the very fine amount of organic solvent is added. In this case, the addition within the range that the problem of the solvent resistance or VOC (volatile organic compound) is not generated, is effective, and the amount is 0.1–5 weight %, preferably 0.1–3 weight % of total ink weight. Further, it is also possible that the radical polymeric monomer and the initiator are combined, and the hybrid type hardening ink of the radical and cation is made.

The UV ink as described above is jetted on the recording medium 2 by the ink jet recording method. Then, UV ink which is received on the recording medium 2 is irradiated with UV radiation (active energy ray) to be cured.

It is preferable that a total thickness of the jetted ink which is received on the recording medium 2, irradiated with UV radiation and cured, is 2–20 μm. In the field of screen image recording, the total thickness of the ink is more than 20 μm in the present. However, in the field of the soft packing print using thin plastic material as the recording medium 2, the ink more than 20 μm in thickness can be used because of not only problems with curl and wrinkle of the recording medium 2 but also problems of change in tension and texture of the whole image recorded matter.

Further, according to the embodiment, it is preferable that the amount of a drop of jetted ink is 2–15 pl. In order to record high-quality images, it is necessary that the amount of a drop of jetted ink is determined within the range of 2–15 pl. However, in case the 2–15 pl ink is jetted per drop, specially, because the jetting stability of the ink from each line head 21 becomes severe, an acid breeding agent is necessary.

Further, according to the embodiment, it is preferable that the ink is irradiated with UV radiation in 0.001–2.0 seconds after the ink jetted is received on the recording medium 2, more preferably in 0.001–1.0 second, as the radiation condition of the active energy ray. In order to record high-quality images, in particular, it is important that the irradiating timing is as soon as possible.

Further, it is one of the preferred methods to divide irradiation step of the UV radiation into two steps. In the method, the ink is first irradiated with UV radiation in 0.001–2.0 seconds after the jetted ink is received on the recording medium 2, and further irradiation of UV radiation is carried out again. Since irradiation of the UV radiation is divided into two steps, the shrink of the recording medium 2 which occurs during the ink curing can be restrained more.

In the embodiment, it is preferable to use UV radiation with low illuminance, in which the maximum illuminance of the effective wavelength band to the curability of ink is 0.1 to 50 mW/cm$^2$. Usually, in the UV ink jet recording method, in order to prevent the dot from spreading and blotting just after the jetted ink is received, the light source with high illuminance in which the maximum illuminance in the wavelength band effective for curing the ink is more than 50 mW/cm$^2$ is used. However, in case of using such light source, the recording medium 2 shrinks largely, and specially, a shrink label used as the recording medium 2 shrinks extremely largely. Therefore, it is substantially impossible to use UV radiation having the maximum illuminance of more than 50 mW/cm$^2$. According to the present embodiment, because an acid amplification is used, it is possible to record a high-quality image without the shrinkage of the recording medium 2 even by using UV radiation having low illuminance in which the maximum illuminance in the wavelength band effective for curing the ink is 0.1 to 50 mW/cm$^2$.

Further, it is effective to use UV radiation in which the maximum illuminance in the wavelength band effective for curing the ink is 50 to 3000 mW/cm$^2$.

As an example of the light source 22 which is used for irradiation of the UV radiation, the following light sources can apply. That is, they are, a low-pressure mercury lamp, a UV radiation laser, a xenon flush lamp, an insect lamp, a black light, a germicidal lamp, a cold-cathode tube, a LED high-pressure mercury lamp, a metal lamp halide lamp, an electrodeless UV radiation lamp, or the like, however, the light source is not limited thereto.

Next, the recording medium 2 used in the present embodiment will be explained. The recording medium 2 used in the embodiment can apply various non-absorptive plastic and a film made of non-absorptive plastic used in so-called soft packing as well as a normal non-coated paper, coated paper or the like. For example, as various plastic films, a PET (polyethylene terephthalate) film, an OPS (oriented polystyrene) film, an OPP (oriented polypropylene) film, a ONy (oriented nylon) film, a PVC (oriented poly vinyl chloride) film, a PE (polyethylene) film, and a TAC (triacetyl cellulose) film can be listed. As the other plastic films, polycarbonate, acrylic resin, ABS (acrylonitorile butadiene styrene), polyacetal, PVA (poly vinyl alcohol), rubber or the like, can be used.

In addition, metal, glass or the like can be applied as a material for the recording medium 2. In order to record the image on a PET film, an OPS film, an OPP film, an ONy film, or a PVC film capable of shrinking with heat among the above-described films, specially, the structure in the present invention is effective. The reason is that not only this type of recording medium 2 is curled or transformed easily because of heat when ink is cured and shrinks or cured through reaction or the like, but also the film of ink does not follow easily as the shrink of the ink.

According to the present embodiment, it is possible to record a good and high quality image on the recording medium 2 having surface energy covering a wide range of 35–60 mN/m, including an OPP film or an OPS film having low surface energy, and a PET film having relatively high surface energy.

Further, according to the present embodiment, it is more advantageous to use a web of the recording medium 2 in view of cost of the recording medium 2 such as packing cost, production cost or the like, printing efficiency, printable various sizes or the like.

An operation of the ink jet recording apparatus 1 will be explained. An image can be formed by setting an ink cartridge, the recording medium 2 and the like in the ink jet recording apparatus 1 and turning on a power supply.

The ink jet recording apparatus 1 carries out an image forming operation. That is, while an image is formed on the recording medium 2 by the ink jet recording apparatus 1, the driving roller 14 keeps rotating and the UV light sources 22, 22, . . . irradiates UV radiation. The recording medium 2 is wound around the driving roller 14 for carrying the recording medium 2 from the feed roller 6 to the driving roller 14. While the recording medium 2 is carried from the feed roller 6 to the driving roller 14, the line heads 21, 21, . . . jet ink in droplets form from each ink jetting portion accordingly so as to place droplets of the UV ink on the recording medium 2 on the heat plate 53*a*. The droplets of the UV ink received on the recording medium 2 is irradiated with the UV radiation which is emitted from the UV light source 22 to cure the ink. Thus, an image is formed on the recording medium 2.

While an image is formed on the recording medium 2, the control section 54 controls the temperature adjusting section 53 so as to have the temperature of the recording medium 2 within the preset target temperature range. The preset target temperature range is a temperature range in which the UV ink is cured enough even under any humidity around the image forming position. An example of a control by the control section 54 will be explained below. In this case, in the preset target temperature range, the upper limit value is an upper threshold temperature and the lower limit value is a lower threshold temperature.

The control section 54 judges whether the detected temperature which is input from the temperature detecting section 51 is within the preset target temperature range. If the detected temperature is higher than the upper threshold temperature, the control section 54 instructs the temperature adjusting section 53 to carry out the cooling operation when the temperature adjusting section 53 is applying heat to the recording medium 2 or the temperature adjusting section 53 carries out neither heating or cooling. The control section 54 stops heating by the temperature adjusting section 53 or lowers heating energy by the temperature adjusting section 53 when the temperature adjusting section 53 is applying heat to the recording medium 2. Further, the control section 54 lowers cooling energy by the temperature adjusting section 53 when the temperature adjusting section 53 is cooling the recording medium 2. If the detected temperature is lower than the lower threshold temperature, the control section 54 instructs the temperature adjusting section 53 to carry out the heating operation when the temperature adjusting section 53 is cooling the recording medium 2 or the temperature adjusting section 53 carries out neither heating nor cooling. The control section 54 stops cooling by the temperature adjusting section 53 or lowers cooling energy by the temperature adjusting section 53 when the temperature adjusting section 53 is cooling the recording medium 2. Further, the control section 54 raises heating energy by the temperature adjusting section 53 when the temperature adjusting section 53 is applying heat to the recording medium 2. When the detected temperature is no lower than the lower threshold temperature nor more than the upper threshold temperature, the control section 54 controls the temperature adjusting section 53 to keep the heating or cooling condition.

The control section 54 controls adjustment of the preset target temperature range according to a detected humidity while carrying out the above described temperature control. In this case, the detected humidity is humidity which is detected by using a typical hygrometer of capacitive type or resistive type. The control section 54 carries out processing of judging whether the detected humidity is over a certain threshold humidity. When the detected humidity is higher than certain threshold humidity, the control section 54 raises the upper threshold temperature and the lower threshold temperature of the preset target temperature range. When the detected humidity is equal to or less than certain threshold humidity, the control section 54 lowers the upper threshold temperature and the lower threshold temperature of the preset target temperature range. After adjusting the upper threshold temperature and the lower threshold temperature in this way, the control section 54 controls the temperature adjusting section 53 so as to have the temperature of the recording medium 2 within the preset target temperature range as described above. A number of values may be set or memorized in the control section 54 as threshold humidity.

The following processing may be carried out for controlling adjustment of the preset target temperature range. A data table as shown in FIG. 3 is pre-memorized in a memory or the like of the control section 54. In the data table, an item of an upper threshold temperature and a lower threshold temperature correspond to an item of humidity. In FIG. 3, when the humidity is defined as follows: Humidity a1<Humidity a2<Humidity a3<Humidity a4<Humidity a5 (Each Humidity a1–a5 has certain range without overlapping with each other. For example, 0%≦Humidity a1<20%, 20%≦Humidity a2<40%, 40%≦Humidity a3<60%, 60%≦Humidity a4<80%, 80%≦Humidity a5≦100%), the upper threshold temperature and the lower threshold temperature are defined as follows: Upper threshold temperature b1≦Upper threshold temperature b2≦Upper threshold temperature b3≦Upper threshold temperature b4≦Upper threshold temperature b5 (b1–b5 are constant); and Lower threshold temperature c1≦Lower threshold temperature c2≦Lower threshold temperature c3≦Lower threshold temperature c4≦Lower threshold temperature c5 (c1–c5 are constant).

The control section 54 judges an appropriate item of humidity from the data table in FIG. 3 for the detected humidity. The control section 54 sets the upper threshold temperature and the lower threshold temperature corresponding to the appropriate item of humidity, and controls the temperature adjusting section 53 to have the temperature of the recording medium 2 within the preset target temperature range as described above.

For example, if the control section 54 judges that the detected humidity corresponds to Humidity a1, the control section 54 sets the upper threshold temperature as b1 and the lower threshold temperature as c1, and judges whether the detected temperature is within the range between the lower threshold temperature c1 and the upper threshold temperature b1. The control section 54 controls the temperature adjusting section 53 based on the judged result as described above.

In the embodiment as described above, the temperature of the recording medium 2 is controlled within the preset target temperature range by the medium temperature controlling mechanism 50, so that the temperature of the recording medium 2 can be substantially constant. Viscosity of the received UV ink can be substantially constant based on the temperature of the recording medium 2 by having the temperature of the recording medium 2 substantially constant. Thus, the quality for forming image can be improved. In this case, since the temperature of the recording medium 2 is substantially constant, the time which is needed for the ink to be cured by changing the state from low viscosity to high viscosity is consistently stable.

Accordingly, a diameter of droplets of the UV ink on the recording medium 2 is consistently stable.

Further, the jetted ink is received on the recording medium 2 which temperature is controlled by the temperature adjusting section 53 so as to cure the UV ink enough even under the condition of high humidity. Thus, the UV ink received on the recording medium 2 is activated by the recording medium 2, and the UV ink is reliably cured. Even under the condition of high humidity, all UV ink received on the recording medium 2 are reliably cured in almost similar condition by irradiation of the UV radiation and the temperature of the recording medium 2. Accordingly, adherability and blotting property to the recording medium 2 are consistently stable. In addition, a diameter of the UV ink dot becomes stable and color mixing does not occur.

The curing property of the UV ink is determined according to an ambient humidity. Specially, although the temperature in which the ink is cured enough is affected by an ambient humidity, in the present embodiment, the preset target temperature range is adjusted according to the detected humidity. Accordingly, the UV ink received on the recording medium 2 is cured at an appropriate curing speed even when the humidity changes. That is, the quality for forming an image is not deteriorated according to an ambient humidity, so that a high quality image can be formed.

Further, because the line heads 21 jet ink in droplets form at the image forming portion 4, an image can be formed on the recording medium 2 even if the recording medium 2 is carried continuously without being stopped. Since the recording medium 2 is carried continuously, the recording medium 2 is heated or cooled by the temperature adjusting section 53 (for example, the driven roller 9 or the heat plate 53*a*) without partially focused. Thus, the temperature of the recording medium 2 can be approximately constant within the preset target temperature range. Accordingly, a diameter of the jetted ink dot received on the recording medium 2 can be stabilized more reliably.

Further, because the ink is cationic polymerization ink in the present embodiment, the ink does not shrink while curing. Thus, even if the recording medium 2 is soft or hard, the shrinkage of the recording medium 2 can be prevented when the ink is cured.

According to the embodiment, the jetted ink received on the recording medium can obtain a temperature in which the ink is cured enough, and the recording medium can obtain a temperature which is not adversely affected by the radiation of the active energy ray by having the temperature of the recording medium substantially constant, so that the jetted ink received on the recording medium can be cured in a short time by the radiation of the active energy ray.

Further, it is unnecessary to make the line head scan so that the recording medium can be carried continuously without being stopped. Since the recording medium is carried continuously, the recording medium is heated or cooled without partially focused, so that the temperature of the recording medium can be approximately constant within the preset target temperature.

Accordingly, the diameter of the jetted ink dot received on the recording medium can be stabilized more reliably.

The entire disclosure of Japanese Patent Application No. Tokugan 2002-250637 which was filed on Aug. 29, 2003, including specification, claims, drawings and summary are incorporated herein by reference in its entirety.

What is claimed is:

1. An ink jet recording apparatus for forming an image on a recording medium, comprising:

a carrying section for carrying the recording medium;

a line head for jetting ink to the recording medium, the head line being provided in a direction approximately perpendicular to a carrying direction of the recording medium which is carried by the carrying section;

an ultraviolet radiation section for radiating an ultraviolet ray to the ink jetted on the recording medium to cure the ink; and a temperature controlling mechanism for controlling the temperature of the recording medium which is carried by the carrying section within a preset target temperature range, before the jetted ink is received on the recording medium;

wherein the ink has cationic polymerization characteristics.

2. The ink jet recording apparatus of claim 1, wherein the temperature controlling mechanism controls a temperature of the recording medium which is carried by the carrying section within the preset target temperature range at least at one of an image forming position facing to the line head where an image is formed on the recording medium by receiving the jetted ink on the recording medium carried by the carrying section, and a position which is in an upstream position from the image forming position in a carrying direction.

3. The ink jet recording apparatus of claim 1, wherein a heat quantity loss is not more than 15% of a heat quantity which is applied to the recording medium, when the recording medium is carried to the image forming position after receiving a certain heat quantity which is determined by adjusting temperature of the recording medium, in a case of the temperature controlling mechanism being provided only at the upstream position in the carrying direction.

4. The ink jet recording apparatus of claim 2, wherein the upstream position of the image forming position in the carrying direction is from a start point of a printing region to a position which is double widths of the printing region away from the start point.

5. The ink jet recording apparatus of claim 1, wherein the temperature controlling mechanism comprises:

a temperature detecting section for detecting temperature of the recording medium;

a temperature adjusting section for carrying out at least one of heating and cooling of the recording medium which is carried by the carrying section; and a control section for controlling the temperature adjusting section by comparing a temperature detected by the temperature detecting section with a preset temperature.

6. The ink jet recording apparatus of claim 5, further comprising:

a humidity detecting section for detecting humidity around the recording medium;

wherein the preset temperature is changed according to the detected humidity.

7. The ink jet recording apparatus of claim 6, wherein the preset temperature rises corresponding to an increase of the detected humidity.

8. The ink jet recording apparatus of claim 1, wherein the preset temperature is changed according to the type of the recording medium.

9. The ink jet recording apparatus of claim 1, wherein the temperature adjusting section is in contact with a back surface of a platen with which the recording medium is in contact, the platen keeping the recording medium flat on the printing region.

10. The ink jet recording apparatus of claim 5, wherein the temperature adjusting section comprises a heat roller which is rotatably supported around a shaft and emits heat, and a periphery of the heat roller is in contact with the recording medium along at least 90 degrees of center angle.

11. The ink jet recording apparatus of claim 5, wherein the temperature adjusting section comprises a heat plate which emits heat, and the heat plate is in contact with the recording medium by a component of a force which is generated when carrying the recording medium.

12. The ink jet recording apparatus of claim 1, wherein the temperature adjusting section comprises a peltier element which is used with a heat transfer member for transferring heat to the recording medium, and the heat transfer member is in contact with the recording medium by a component of a force which is generated when carrying the recording medium.

13. The ink jet recording apparatus of claim 5, wherein the temperature adjusting section comprises an air blowing apparatus which directs heated air to the recording medium carried by the carrying section.

14. The ink jet recording apparatus of claim 5, wherein the temperature adjusting section is arranged in the opposite side of the line head across the recording medium which is carried by the carrying section.

15. The ink jet recording apparatus of claim 1, wherein an amount of a droplet of the ink which is jetted from the line head to the recording medium is 2–15 pl.

16. The ink jet recording apparatus of claim 1, wherein the active energy ray is radiated in 0.001–2.0 seconds after the jetted ink is received on the recording medium.

17. The ink jet recording apparatus of claim 1, wherein radiation of the active energy ray is divided into a plurality of steps.

18. An ink jet recording apparatus for forming an image on a recording medium, comprising:

a carrying section for carrying the recording medium;

a line head for jetting ink to the recording medium, the head line being provided in a direction approximately perpendicular to a carrying direction of the recording medium which is carried by the carrying section;

an active energy ray radiation section for radiating an active energy ray to the ink jetted on the recording medium to cure the ink; and a temperature controlling mechanism for controlling the temperature of the recording medium which is carried by the carrying section within a preset target temperature range;

wherein a heat quantity loss is not more than 15% of a heat quantity which is applied to the recording medium, when the recording medium is carried to the image forming position after receiving a certain heat quantity which is determined by adjusting temperature of the recording medium, in a case of the temperature controlling mechanism being provided only at the upstream position in the carrying direction.

19. An ink jet recording apparatus for forming an image on a recording medium, comprising:

a carrying section for carrying the recording medium;

a line head for jetting ink to the recording medium, the head line being provided in a direction approximately perpendicular to a carrying direction of the recording medium which is carried by the carrying section;

an active energy ray radiation section for radiating an active energy ray to the ink jetted on the recording medium to cure the ink; and a temperature controlling mechanism for controlling the temperature of the recording medium which is carried by the carrying section within a preset target temperature range;

wherein the temperature adjusting section comprises a peltier element which is used with a heat transfer member for transferring heat to the recording medium, and the heat transfer member is in contact with the recording medium by a component of a force which is generated when carrying the recording medium.

20. An ink jet recording apparatus for forming an image on a recording medium, comprising:

a carrying section for carrying the recording medium;

a line head for jetting ink to the recording medium, the head line being provided in a direction approximately perpendicular to a carrying direction of the recording medium which is carried by carrying section;

an ultraviolet radiation section for radiating an ultraviolet ray to the ink jetted on the recording medium to cure the ink; and a temperature controlling mechanism for controlling the temperature of the recording medium which is carried by the carrying section within a preset target temperature range, before the jetted ink is received on the recording medium;

wherein the ultraviolet ray is radiated in 0.001–2.0 seconds after the jetted ink is received on the recording medium;

wherein the ink has cationic polymerization characteristics.

* * * * *